US010570919B2

(12) United States Patent
Yamaguchi et al.

(10) Patent No.: US 10,570,919 B2
(45) Date of Patent: Feb. 25, 2020

(54) CENTRIFUGAL FAN AND VENTILATION FAN

(71) Applicant: Mitsubishi Electric Corporation, Chiyoda-ku, Tokyo (JP)

(72) Inventors: Keijiro Yamaguchi, Tokyo (JP); Kazuki Okamoto, Tokyo (JP); Hitoshi Kikuchi, Tokyo (JP); Takahiro Kosaki, Tokyo (JP)

(73) Assignee: MITSUBISHI ELECTRIC CORPORATION, Chiyoda-ku, Tokyo (JP)

( * ) Notice: Subject to any disclaimer, the term of this patent is extended or adjusted under 35 U.S.C. 154(b) by 158 days.

(21) Appl. No.: 15/740,928

(22) PCT Filed: Aug. 26, 2015

(86) PCT No.: PCT/JP2015/073976
§ 371 (c)(1),
(2) Date: Dec. 29, 2017

(87) PCT Pub. No.: WO2017/033303
PCT Pub. Date: Mar. 2, 2017

(65) Prior Publication Data
US 2018/0187694 A1 Jul. 5, 2018

(51) Int. Cl.
*F04D 29/42* (2006.01)
*F04D 25/08* (2006.01)
(Continued)

(52) U.S. Cl.
CPC ..... *F04D 29/4226* (2013.01); *F04D 17/16* (2013.01); *F04D 25/08* (2013.01);
(Continued)

(58) Field of Classification Search
CPC ..... F04D 29/4213; F04D 29/4226; F05D 2260/96; F05D 2250/51
See application file for complete search history.

(56) References Cited

U.S. PATENT DOCUMENTS 820,399 A * 5/1906 Davidson ..... F04D 29/4226 415/204
4,255,080 A * 3/1981 Wilson ..... F04D 29/4226 415/52.1
(Continued)

FOREIGN PATENT DOCUMENTS

CN 101535656 A 9/2009
JP 08-094146 A 4/1996
(Continued)

OTHER PUBLICATIONS

Office Action (Notification of Reasons for Refusal) dated Jul. 24, 2018, by the Japanese Patent Office in corresponding Japanese Patent Application No. 2017-536128 and English translation of the Office Action. (5 pages).
(Continued)

*Primary Examiner* — Ninh H. Nguyen
(74) *Attorney, Agent, or Firm* — Buchanan Ingersoll & Rooney PC

(57) ABSTRACT

A centrifugal fan includes: an impeller driven by a drive motor to rotate; a scroll casing including an inlet-port face having an opening and a wall portion having positions at which distances from an axis line that is a rotation center of the impeller differ from each other, and changing an air flow in a centrifugal direction generated by rotation of the impeller into an air flow in one direction; an air admitting portion including a bell mouth portion having a large-diameter side end placed on an inlet-air-flow upstream side of the inlet-port face; and a protruding portion extending from the air admitting portion in a direction orthogonal to the axis line,
(Continued)

which is the rotation center of the impeller, and in a direction away from the rotation center and surrounding part of the bell mouth portion.

14 Claims, 8 Drawing Sheets

(51) Int. Cl.
*F04D 17/16* (2006.01)
*F04D 29/44* (2006.01)

(52) U.S. Cl.
CPC ..... *F04D 29/4213* (2013.01); *F04D 29/441* (2013.01); *F05B 2240/14* (2013.01); *F05B 2260/96* (2013.01); *F05D 2250/51* (2013.01)

(56) References Cited

U.S. PATENT DOCUMENTS

| | | | | |
|---|---|---|---|---|
| 5,525,036 | A * | 6/1996 | Park | F04D 29/4213 415/208.1 |
| 7,677,865 | B2 * | 3/2010 | Han | F04D 29/4213 415/119 |
| 8,123,468 | B2 | 2/2012 | Shirahama et al. | |
| 2015/0198178 | A1 * | 7/2015 | Kawasaki | F04D 29/422 415/119 |

FOREIGN PATENT DOCUMENTS

| | | | |
|---|---|---|---|
| JP | 10-018996 | A | 1/1998 |
| JP | 2010-071475 | | 4/2010 |
| JP | 2011-001838 | A | 1/2011 |
| JP | 2014-055557 | A | 3/2014 |
| JP | 2014-190652 | A | 10/2014 |

OTHER PUBLICATIONS

Japanese Office Action dated Jan. 22, 2019 issued by the Japan Patent Office in Japanese Patent Application No. 2017-536128, with English translation (4 pages).
Chinese Office Action dated Feb. 28, 2019 issued by the Chinese Patent Office in Chinese Patent Application No. 201580082320.9, with English translation (18 pages).
Notice of Submission of Publication dated Oct. 24, 2018, by the Japanese Patent Office in corresponding Japanese Patent Application No. 2017-536128, and English translation thereof. (33 pages).
International Search Report (PCT/ISA/210) dated Dec. 1, 2015, by the Japanese Patent Office as the International Searching Authority for International Application No. PCT/JP2015/073976.
Written Opinion (PCT/ISA/237) dated Dec. 1, 2015, by the Japanese Patent Office as the International Searching Authority for International Application No. PCT/JP2015/073976.
Office Action dated Sep. 16, 2019, by the Chinese Patent Office in corresponding Chinese Patent Application No. 201580082320.9 and English translation of the Office Action. (11 pages).

* cited by examiner

CENTRIFUGAL FAN AND VENTILATION FAN

FIELD

The present invention relates to a centrifugal fan including a scroll casing, and a ventilation fan.

BACKGROUND

In centrifugal fans, a scroll casing is formed with a bell-mouth shaped air admitting portion in its inlet-port face, which is a face having an opening, an impeller is accommodated in the scroll casing, and air flow is generated by the rotation of the impeller. In such a centrifugal fan, a noise generated in the scroll casing due to the rotation of the impeller or the operation of a drive motor is emitted through the air admitting portion.

In Patent Literature 1, a structure is disclosed in which an orifice that corresponds to the air admitting portion protrudes on an inlet-air-flow upstream side of the lower end of an inlet casing having an inlet port. In the invention disclosed in Patent Literature 1, the inlet casing corresponds to the scroll casing and the lower end of the inlet casing having the inlet port corresponds to the inlet-port face having the opening.

CITATION LIST

Patent Literature

Patent Literature 1: Japanese Patent No. 3279834

SUMMARY

Technical Problem

As in the case with the invention disclosed in Patent Literature 1, a centrifugal fan can achieve a noise reduction by placing an air admitting portion so as to protrude on the inlet-air-flow upstream side. A further noise reduction, however, is desired in a centrifugal fan to achieve a further quieter ventilation fan.

The present invention has been achieved in view of the above, and an object of the present invention is to provide a centrifugal fan that achieves a noise reduction.

Solution to Problem

To solve the problem described above and achieve the object described above, an aspect of the present invention provides a centrifugal fan including: an impeller to be driven by a drive motor so as to rotate; a scroll casing to change an air flow in a centrifugal direction generated by rotation of the impeller into an air flow in one direction, the scroll casing including an inlet-port face having an opening, and a wall portion having positions at which distances from an axis line that is a rotation center of the impeller differ from each other; and an air admitting portion including a bell mouth portion having a large-diameter side end placed on an inlet-air-flow upstream side of the inlet-port face. An aspect of the present invention includes a protruding portion extending from the air admitting portion in a direction orthogonal to the axis line and in a direction away from the rotation center and surrounding part of the bell mouth portion.

Advantageous Effects of Invention

A centrifugal fan according to the present invention produces an effect of enabling a noise reduction.

DESCRIPTION OF EMBODIMENTS

A centrifugal fan and a ventilation fan according to embodiments of the present invention will be described below in detail with reference to the drawings.

First Embodiment

Figure 1:
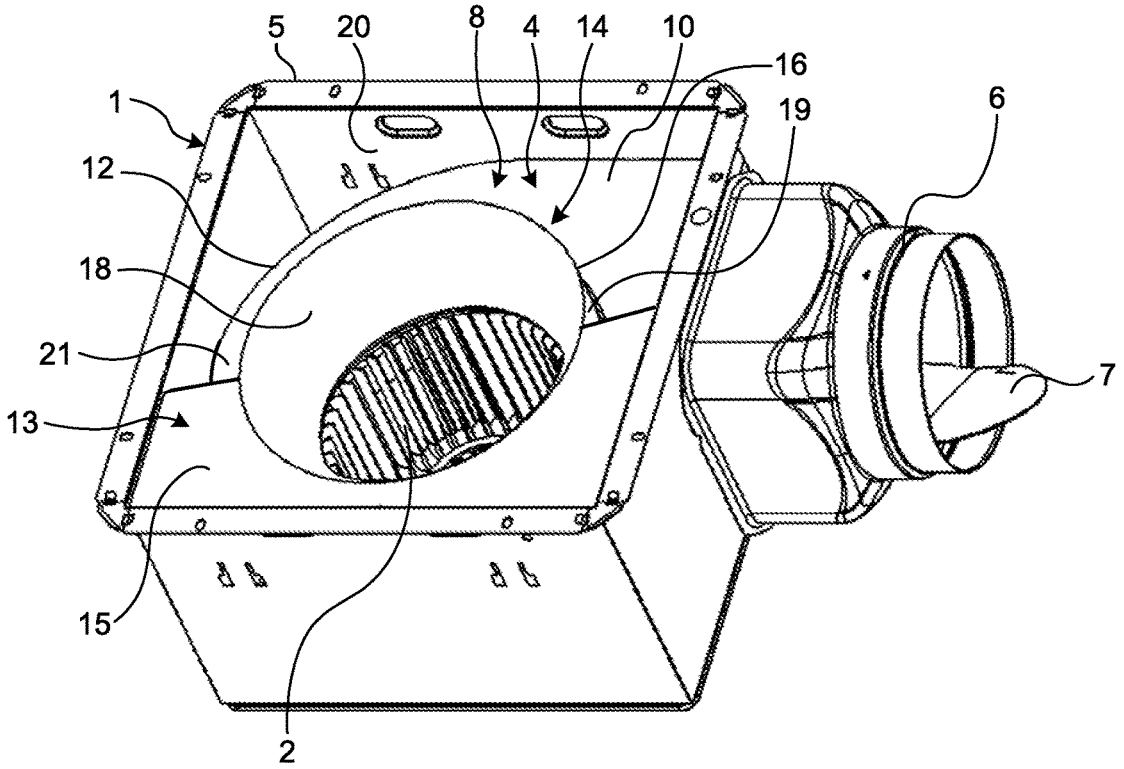
FIG. 1 is a perspective view of a ventilation fan according to a first embodiment.
Figure 2:
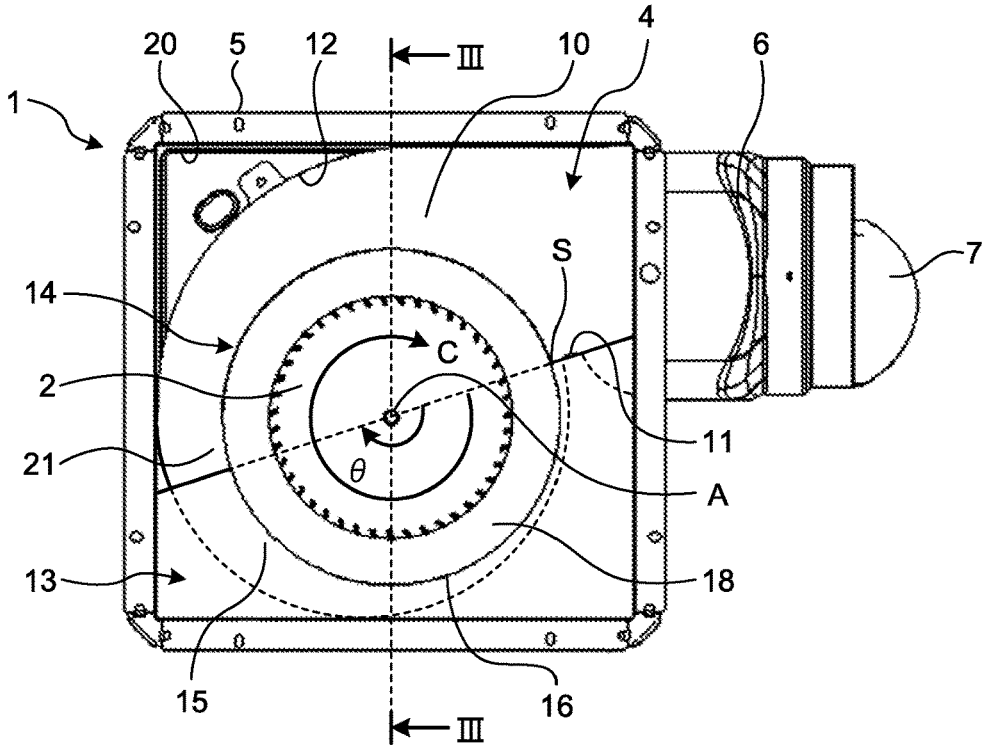
FIG. 2 is a plan view of the ventilation fan according to the first embodiment.
Figure 3:
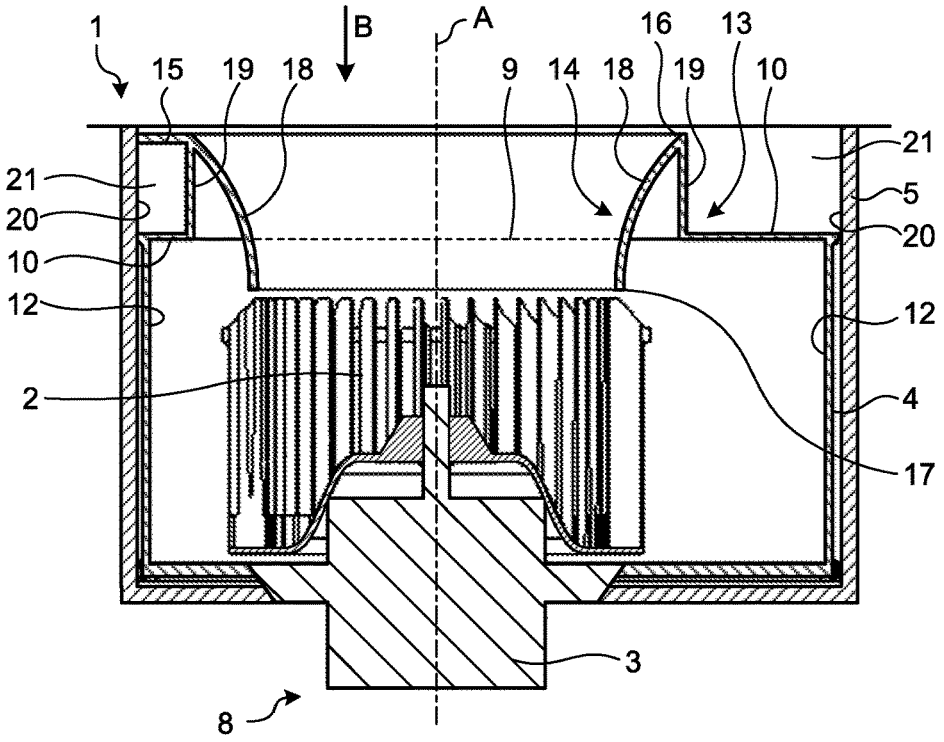
FIG. 3 is a sectional view of the ventilation fan according to the first embodiment.

FIG. 1 is a perspective view of a ventilation fan according to a first embodiment. FIG. 2 is a plan view of the ventilation fan according to the first embodiment. FIG. 3 is a sectional view of the ventilation fan according to the first embodiment. FIG. 3 illustrates a section along line III-III in FIG. 2. As illustrated in FIGS. 1, 2, and 3, a ventilation fan 1 includes an impeller 2, which generates an air flow in a centrifugal direction; a drive motor 3, which drives the impeller 2; a scroll casing 4, which accommodates the impeller 2; a housing 5, which has a box-like shape and houses the scroll casing 4; and a shutter 7, which opens and closes a duct connection member 6 connected to an outlet port of the scroll casing 4. The impeller 2 is connected to the drive motor 3 and driven by the drive motor 3 so as to rotate.

The impeller 2, the scroll casing 4, the housing 5, the duct connection member 6, and the shutter 7 are made from a metal material.

The drive motor 3, the impeller 2, and the scroll casing 4 configure a centrifugal fan 8. The centrifugal fan 8 is accommodated in the housing 5.

The scroll casing 4 includes an inlet-port face 10 having an opening 9; a tongue portion 11, which changes an air flow in a centrifugal direction generated in the scroll casing 4 by the rotation of the impeller 2 into an air flow in one direction toward the outlet port; a wall portion 12, which extends such that the distance between the wall portion 12 and an axis line A, which is the rotation center of the impeller 2, increases as the angle from the tongue portion 11 along the rotation direction of the impeller 2 increases; and an air admitting portion 13 placed at the opening 9. The scroll casing 4 has a function of changing an air flow in the centrifugal direction generated by the rotation of the impeller 2 into an air flow in the one direction. The air admitting portion 13 is formed integrally with the scroll casing 4. The position of the opening 9 is indicated by a phantom line in FIG. 3.

The distance between the axis line A, which is the rotation center of the impeller 2, and the wall portion 12 is minimum at the tongue portion 11.

The air admitting portion 13 includes an inlet portion 14, which has a tube-like shape and through which inlet air passes; and a protruding portion 15, which extends from the inlet portion 14 in a direction orthogonal to the axis line A, which is the rotation center of the impeller 2, and in a direction away from the axis line A. The inlet portion 14 includes a bell mouth portion 18, which penetrates the inlet-port face 10 and has a large-diameter side end 16 placed on an inlet-air-flow upstream side of the inlet-port face 10 and a small-diameter side end 17 placed on an inlet-air-flow downstream side of the inlet-port face 10; and a support portion 19, which extends from the large-diameter side end 16 of the bell mouth portion 18 in an inlet-air-flow downstream direction so as to connect the bell mouth portion 18 to the inlet-port face 10 and support the bell mouth portion 18. Since the large-diameter side end 16 is placed on the inlet-air-flow upstream side of the inlet-port face 10, the air admitting portion 13 protrudes on the inlet-air-flow upstream side of the inlet-port face 10. A direction of the inlet air flow is indicated by an arrow B in FIG. 3. Specifically, the direction the arrow B points to in FIG. 3 is the inlet-air-flow downstream side.

The protruding portion 15 abuts an inner surface 20 of the housing 5. As illustrated in FIG. 2, the protruding portion 15 extends from an intersection point S of a plane including a point at which the distance from the axis line A to the wall portion 12 is minimum and the axis line A and the large-diameter side end 16 of the bell mouth portion 18 in the rotation direction of the impeller 2 so as to surround part of the bell mouth portion 18. The protruding portion 15 has a center angle θ about the axis line A along the rotation direction of the impeller 2. The rotation direction of the impeller 2 is a direction indicated by an arrow C in FIG. 2.

The protruding portion 15 may extend from an intersection point of a plane obtained by shifting the plane including the point at which the distance from the axis line A to the wall portion 12 is minimum and the axis line A by a range of ±5° in the rotation direction of the impeller 2 and the large-diameter side end 16 of the bell mouth portion 18.

A space between the air admitting portion 13 of the scroll casing 4 and the inner surface 20 of the housing 5 is an extra-pathway space 21.

The centrifugal fan 8 has a reduced tendency to have a pressure loss occurring when inlet air flows through the air admitting portion 13 into the scroll casing 4 as the distance from the axis line A to the wall portion 12 increases. Hence, the centrifugal fan 8 tends to have an increased amount of inlet air and an increased speed at which the inlet air flows therein as the distance from the axis line A to the wall portion 12 increases.

Figure 4:
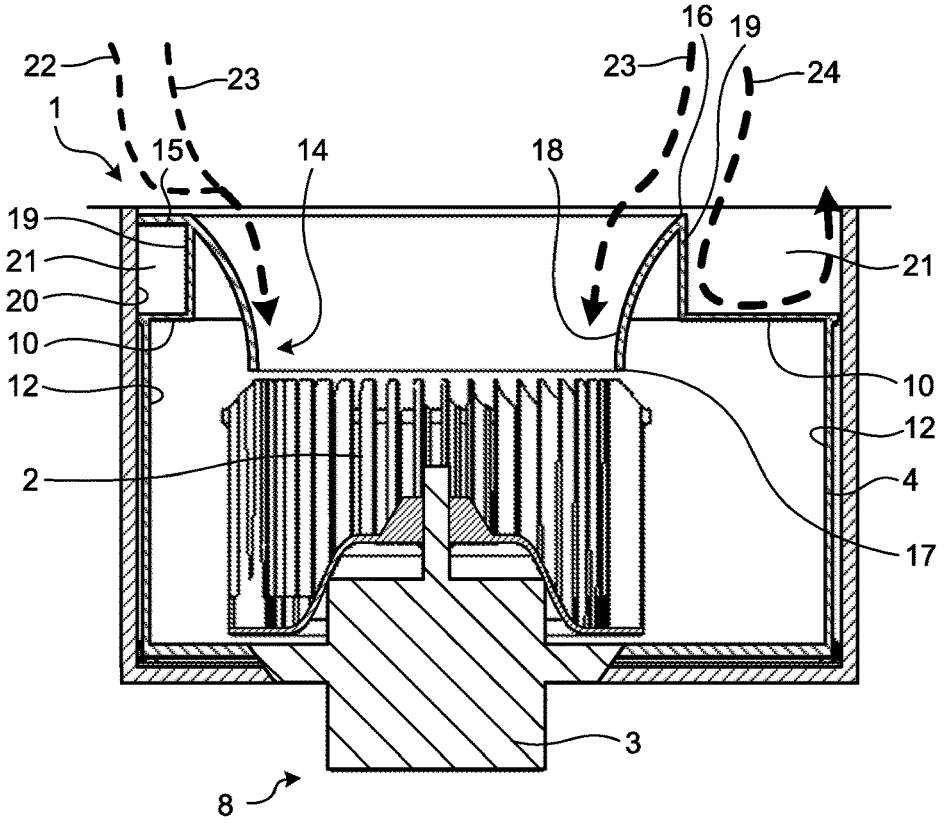
FIG. 4 is a diagram schematically illustrating the flow of inlet air into the ventilation fan according to the first embodiment.

FIG. 4 is a diagram schematically illustrating the flow of inlet air into the ventilation fan according to the first embodiment. An air flow 22 that would flow into the extra-pathway space 21 if there is no protruding portion 15 merges with an air flow 23, which flows into the bell mouth portion 18 regardless of the presence of the protruding portion 15, in an area where the protruding portion 15 is present; accordingly, the flow rate of the inlet air that flows into the bell mouth portion 18 increases. An air flow 24, which flows into the extra-pathway space 21, exists in an area where the protruding portion 15 is not present. That is, the air flow 24 tends not to merge with the air flow 23, which flows into the bell mouth portion 18, in the area where the protruding portion 15 is not present; accordingly, the flow rate of the inlet air that flows into the bell mouth portion 18 does not increase.

Thus, providing the protruding portion 15 in an area where the amount of inlet air is equal to or less than a mean value can increase the amount of inlet air and thereby reduce unevenness in distribution of the speed of inlet air flowing into the scroll casing 4 through the air admitting portion 13.

A noise generated in the scroll casing 4 due to the rotation of the impeller 2 or the operation of the drive motor 3 is emitted through the air admitting portion 13. The extra-pathway space 21 works as an acoustic tube when the noise generated in the scroll casing 4 is emitted. Accordingly, the noise generated when the ventilation fan 1 is operated increases.

In the ventilation fan 1 according to the first embodiment, the protruding portion 15, which extends from the large-diameter side end 16 of the bell mouth portion 18 in the direction orthogonal to the axis line A, which is the rotation center of the impeller 2, and in the direction away from the axis line A, abuts the inner surface 20 of the housing 5 to cover the extra-pathway space 21. In this manner, the ventilation fan 1 according to the first embodiment prevents the extra-pathway space 21 from working as an acoustic tube and inhibits a resonance from being produced in the extra-pathway space 21.

Figure 5:
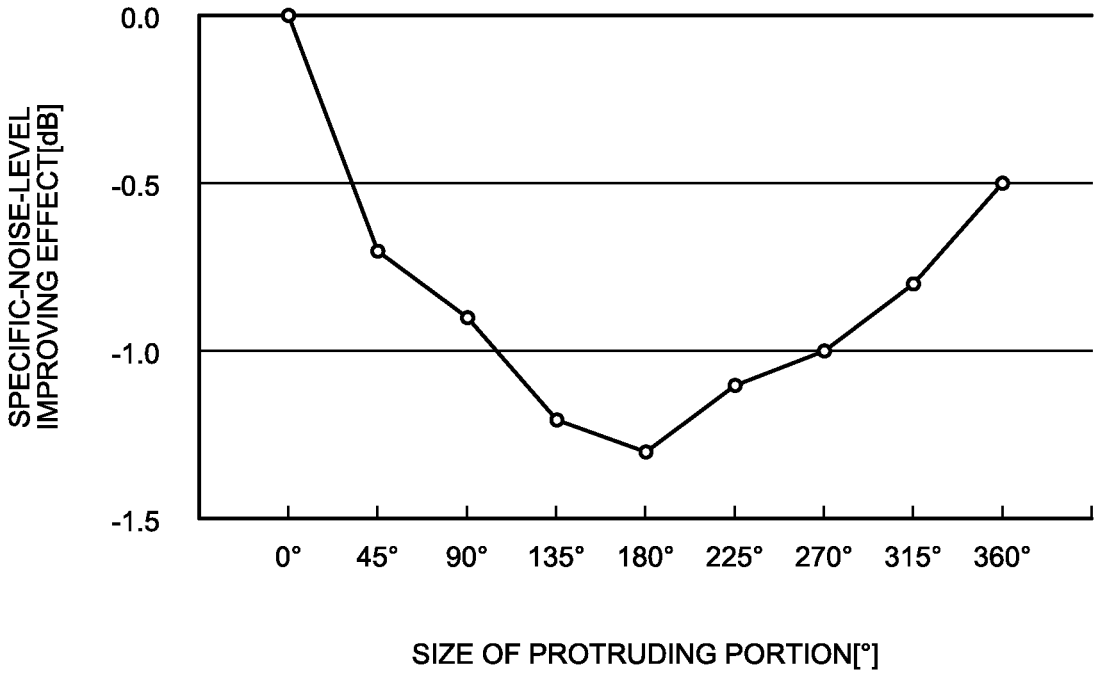
FIG. 5 is a diagram illustrating a relationship between the size of a protruding portion and a specific-noise-level improving effect in the ventilation fan according to the first embodiment.

FIG. 5 is a diagram illustrating the relationship between the size of the protruding portion and a specific-noise-level improving effect in the ventilation fan according to the first embodiment. The protruding portion 15 is formed so as to have lengths that reach the inner surface 20 of the housing 5, and the specific-noise-level improving effect is measured as the angle θ is varied, which is an angle formed in the rotation direction of the impeller 2 from the intersection point S of the plane including the point at which the distance from the axis line A to the wall portion 12 is minimum and the axis line A and the large-diameter side end 16 of the bell mouth portion 18. In FIG. 5, the specific-noise-level improving effect is indicated using a ventilation fan including no protruding portion 15 whose θ=0° as a reference.

The specific noise level K of the centrifugal fan 8 is calculated using a following formula (1).

[Formula 1]

$$K = SPL - 10\log\left(\left(\frac{P}{g}\right)^{2.5} \cdot Q\right) \quad (1)$$

P: total pressure [Pa], Q: quantity of airflow [$m^3$/min], SPL: noise level [dB], g: gravitational acceleration When the value of θ is changed, the values of the noise level SPL, the total pressure P, and the quantity of airflow Q in the formula (1) described above change; hence, the specific noise level K takes different values depending on the value of θ.

As illustrated in FIG. 5, the ventilation fan 1 according to the first embodiment, which includes the protruding portion 15, achieves a smaller specific noise level than a specific noise level of the ventilation fan including no protruding portion 15. When θ is equal to or greater than 110° and equal to or smaller than 270°, the absolute value of a specific-noise-level improving effect in decibels produced by the ventilation fan 1 according to the first embodiment in comparison with the ventilation fan including no protruding portion 15 whose θ=0° is greater than 1.0. When θ is equal to or greater than 120° and equal to or smaller than 225°, the absolute value of a specific-noise-level improving effect in decibels produced by the ventilation fan 1 according to the first embodiment in comparison with the ventilation fan including no protruding portion 15 whose θ=0° is greater than 1.1. The ventilation fan 1 according to the first embodiment achieves the highest specific-noise-level improving effect when the size of the protruding portion 15 is such that θ=180°, producing a specific-noise-level improving effect of −1.3 decibel in comparison with the ventilation fan including no protruding portion 15 whose θ=0°.

Figure 6:
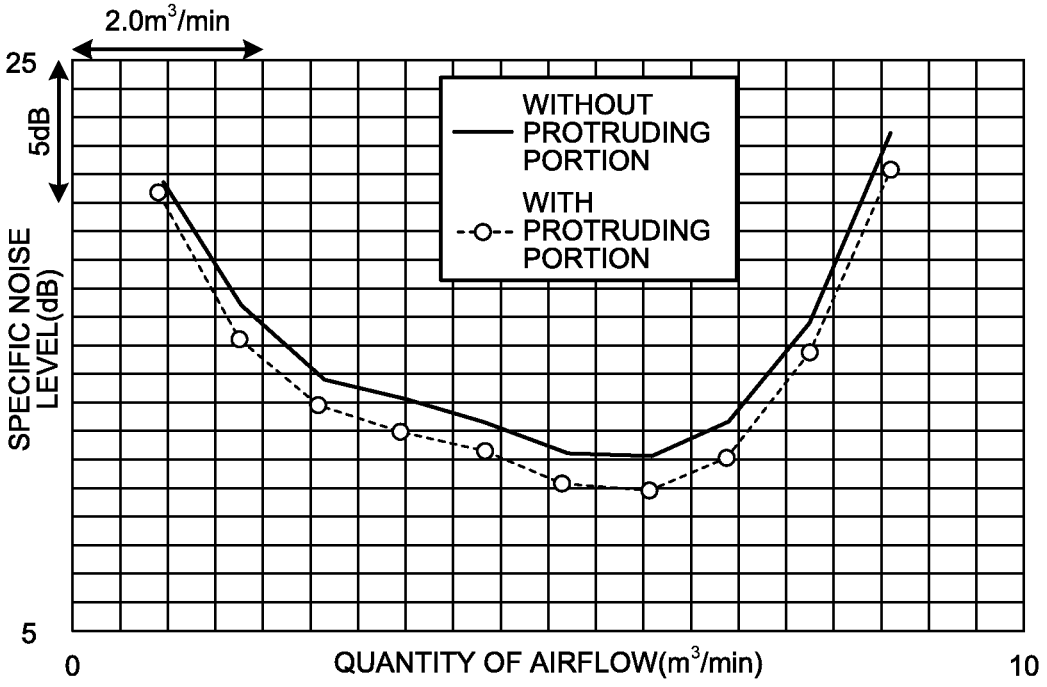
FIG. 6 is a diagram illustrating a noise characteristic of the ventilation fan according to the first embodiment and a noise characteristic of a ventilation fan including no protruding portion.

FIG. 6 is a diagram illustrating a noise characteristic of the ventilation fan according to the first embodiment and a noise characteristic of a ventilation fan including no protruding portion. The size of the protruding portion 15 of the ventilation fan 1 according to the first embodiment whose specific noise level is illustrated in FIG. 6 is θ=180°. As illustrated in FIG. 6, the ventilation fan 1 according to the first embodiment achieves smaller noise values than noise values of the ventilation fan including no protruding portion 15 at any quantity of airflow operated within the measurement range in FIG. 6.

As described above, the ventilation fan 1 according to the first embodiment includes the bell mouth portion 18, which protrudes on the inlet-air-flow upstream side of the inlet-port face 10 of the scroll casing 4. Additionally, the ventilation fan 1 according to the first embodiment includes the protruding portion 15, which extends from the intersection point S of the plane including the point at which the distance from the axis line A to the wall portion 12 is minimum and the axis line A and the large-diameter side end 16 of the bell mouth portion 18 in the rotation direction of the impeller 2 and extends from the large-diameter side end 16 of the bell mouth portion 18 in the direction orthogonal to the axis line A and in the direction away from the axis line A. The protruding portion 15 prevents the inlet air from flowing into the extra-pathway space 21 and guides the inlet air toward the bell mouth portion 18 and thereby can reduce the unevenness in distribution of the speed of the inlet air flowing into the scroll casing 4 through the air admitting portion 13. Additionally, the protruding portion 15 covers the extra-pathway space 21 and thereby can inhibit a resonance from being produced in the extra-pathway space 21.

Note that the protruding portion 15 does not necessarily need to be placed on the large-diameter side end 16 of the bell mouth portion 18. Specifically, the protruding portion 15 may extend from any portion of the inlet portion 14 as long as the protruding portion 15 can guide inlet air that would otherwise flow into the extra-pathway space 21 toward the bell mouth portion 18. The impeller 2, the scroll casing 4, the housing 5, the duct connection member 6, and the shutter 7 may be made from a resin material.

The ventilation fan 1 according to the first embodiment can inhibit a resonance from being produced in the extra-pathway space 21 and reduce the unevenness in distribution of the speed of the inlet air flowing into the scroll casing 4 through the air admitting portion 13, and thus, can reduce a noise produced during the operation of the centrifugal fan 8.

Second Embodiment

Figure 7:
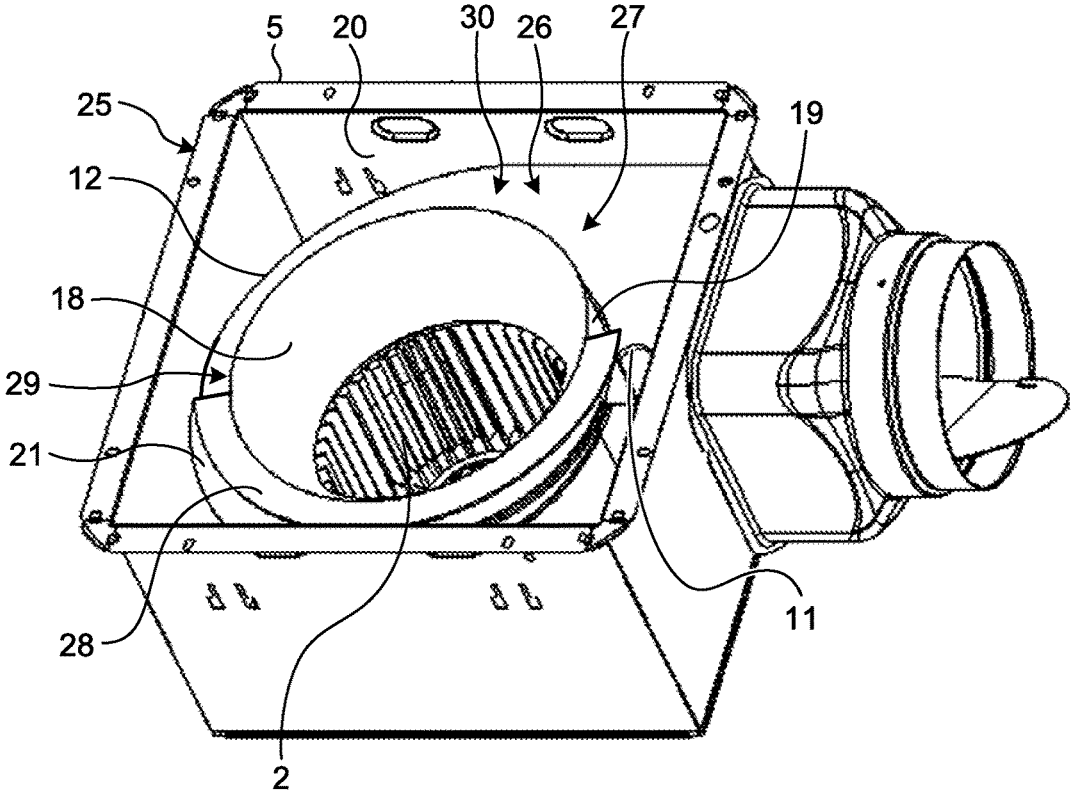
FIG. 7 is a perspective view of a ventilation fan according to a second embodiment.
Figure 8:
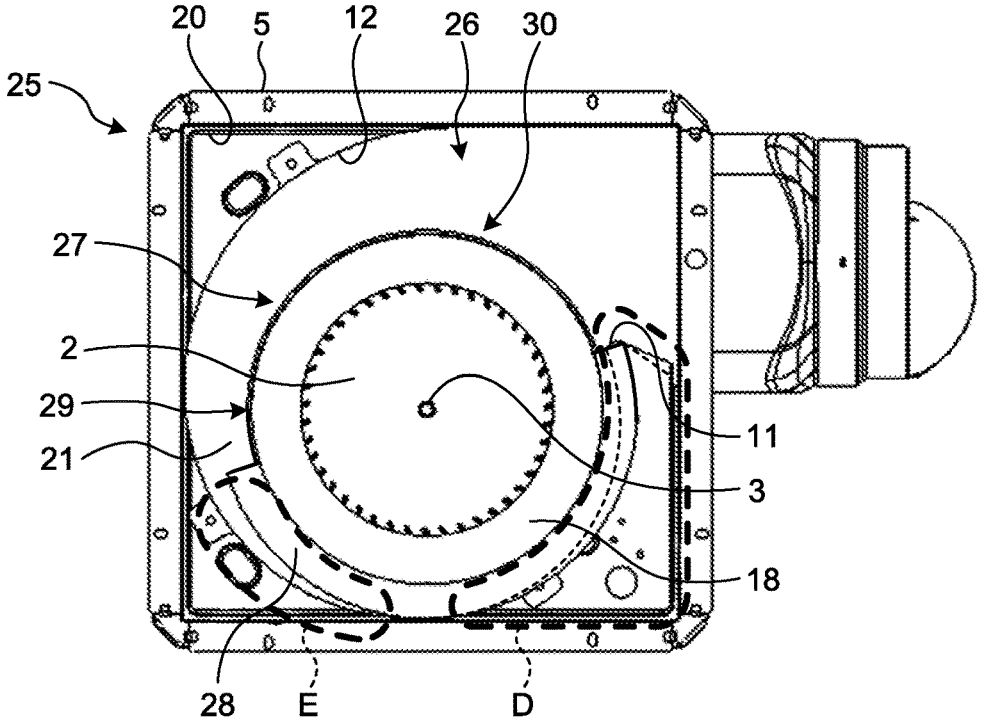
FIG. 8 is a plan view of the ventilation fan according to the second embodiment.

FIG. 7 is a perspective view of a ventilation fan according to a second embodiment of the present invention. FIG. 8 is a plan view of the ventilation fan according to the second embodiment. A ventilation fan 25 according to the second embodiment is different from the ventilation fan 1 according to the first embodiment in that an air admitting portion 27 of a scroll casing 26 includes an inlet portion 29, which includes a protruding portion 28 in place of the protruding portion 15. The other parts are similar to those of the first embodiment. The drive motor 3, the impeller 2, and the scroll casing 26 configure a centrifugal fan 30. The scroll casing 26 is made from a metal material. As in the case with the scroll casing 4 according to the first embodiment, the scroll casing 26 changes an air flow in the centrifugal direction generated by the rotation of the impeller 2 into an air flow in one direction. The air admitting portion 27 is formed integrally with the scroll casing 26.

The protruding portion 28 does not abut the inner surface 20 of the housing 5, and, thus, the ventilation fan 25 according to the second embodiment includes an area where a gap is formed between the protruding portion 28 and the inner surface 20 of the housing 5. In FIG. 8, a gap is formed between the protruding portion 28 and the inner surface 20 of the housing 5 in the areas enclosed in broken-line frames D and E. Although such gaps are present between the protruding portion 28 and the inner surface 20 of the housing 5, the ventilation fan 25 according to the second embodiment can reduce the unevenness in distribution of the speed of the inlet air flowing into the scroll casing 26 through the air admitting portion 27 and inhibit a resonance from being produced in the extra-pathway space 21.

In the centrifugal fan 30 of the ventilation fan 25 according to the second embodiment, at least part of the protruding portion 28 extends so as to reach an extension of the wall portion 12 in a direction along the axis line A. In FIG. 8, the protruding portion 28 extends so as to reach the extension of the wall portion 12 in the direction along the axis line A in the area enclosed in the broken-line frame D.

In the area where the protruding portion 28 extends to reach the extension of the wall portion 12 of the scroll casing 26 in the direction along the axis line A, the effect of reducing the unevenness in distribution of the speed of the inlet air flowing into the scroll casing 26 through the air admitting portion 27 and the effect of inhibiting a resonance from being produced in the extra-pathway space 21 produced by the ventilation fan 25 according to the second embodiment are similar to those produced by the configuration illustrated in FIG. 1 in which the protruding portion 15 abuts the inner surface 20 of the housing 5. This is because the probability of inlet air flowing into the extra-pathway space 21 through a gap between the protruding portion 28 and the inner surface 20 of the housing 5 decreases as the gap is located farther away from the axis line A.

As described above, the ventilation fan 25 according to the second embodiment can reduce a noise during the operation of the centrifugal fan 30. The protruding portion 28 of the ventilation fan 25 according to the second embodiment is smaller than the protruding portion 15 of the ventilation fan 1 according to the first embodiment commensurately with the presence of the gaps between the protruding portion 28 and the inner surface 20 of the housing 5; thus, the centrifugal fan 30 of the ventilation fan 25 according to the second embodiment can achieve a lighter weight than the weight of the centrifugal fan 8 of the ventilation fan 1 according to the first embodiment.

The scroll casing 26 may be made from a resin material.

Third Embodiment

Figure 9:
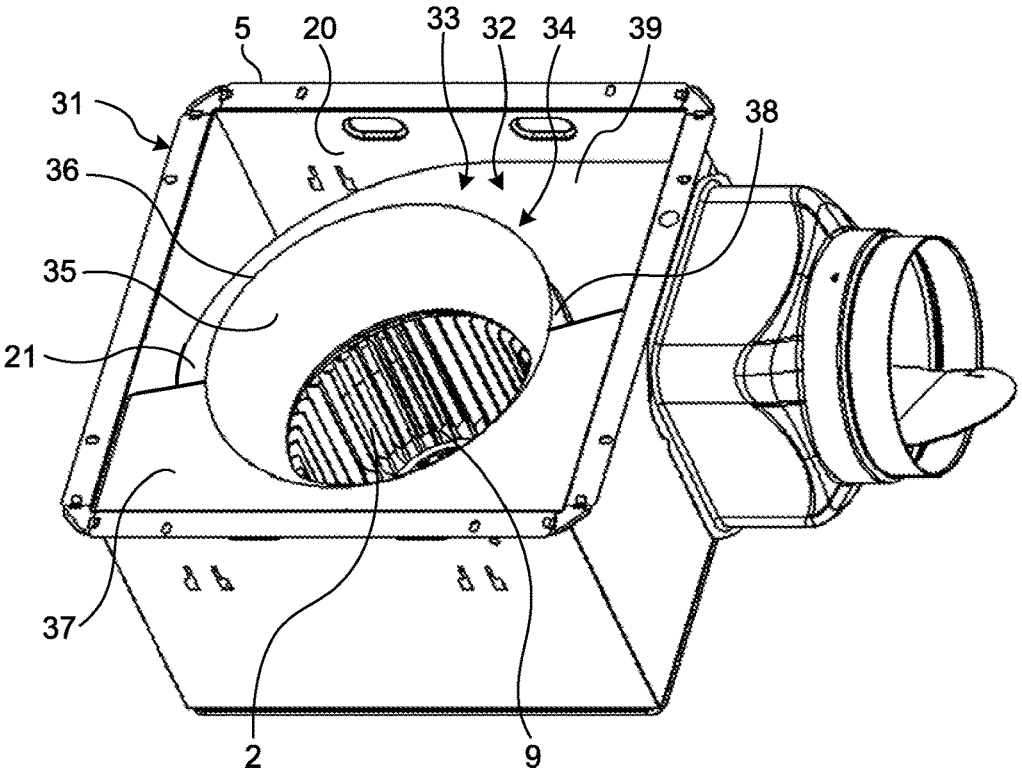
FIG. 9 is a perspective view of a ventilation fan according to a third embodiment.
Figure 10:
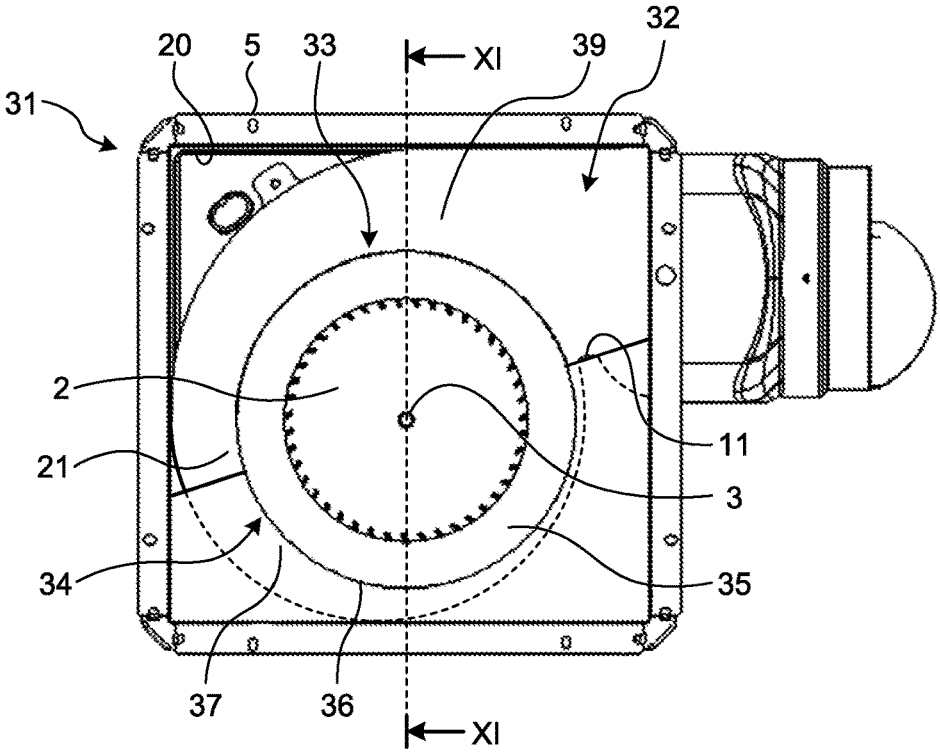
FIG. 10 is a plan view of the ventilation fan according to the third embodiment.
Figure 11:
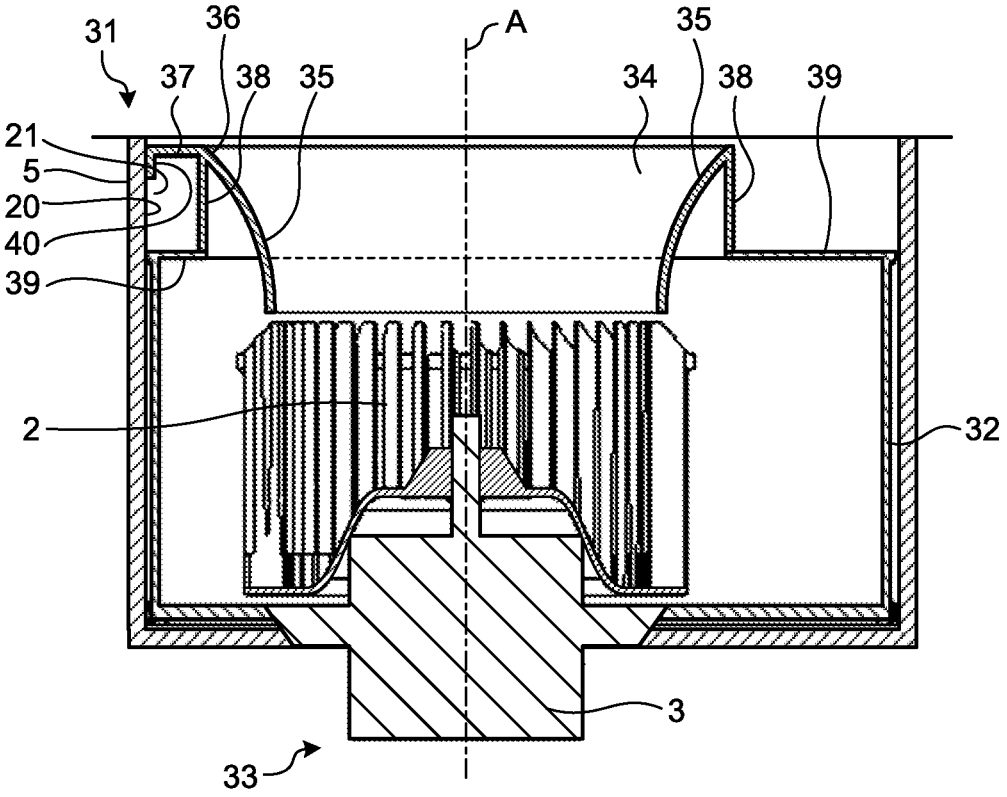
FIG. 11 is a sectional view of the ventilation fan according to the third embodiment.

FIG. 9 is a perspective view of a ventilation fan according to a third embodiment. FIG. 10 is a plan view of the ventilation fan according to the third embodiment. FIG. 11 is a sectional view of the ventilation fan according to the third embodiment. FIG. 11 illustrates a section along line XI-XI in FIG. 10. As illustrated in FIGS. 9, 10, and 11, a ventilation fan 31 includes a scroll casing 32, which accommodates the impeller 2. Otherwise, the third embodiment is similar to the first embodiment. The drive motor 3, the impeller 2, and the scroll casing 32 configure a centrifugal fan 33. The other parts are similar to those of the first embodiment. As in the case with the scroll casing 4 according to the first embodiment, the scroll casing 32 changes an air flow in the centrifugal direction generated by the rotation of the impeller 2 into an air flow in one direction.

Figure 12:
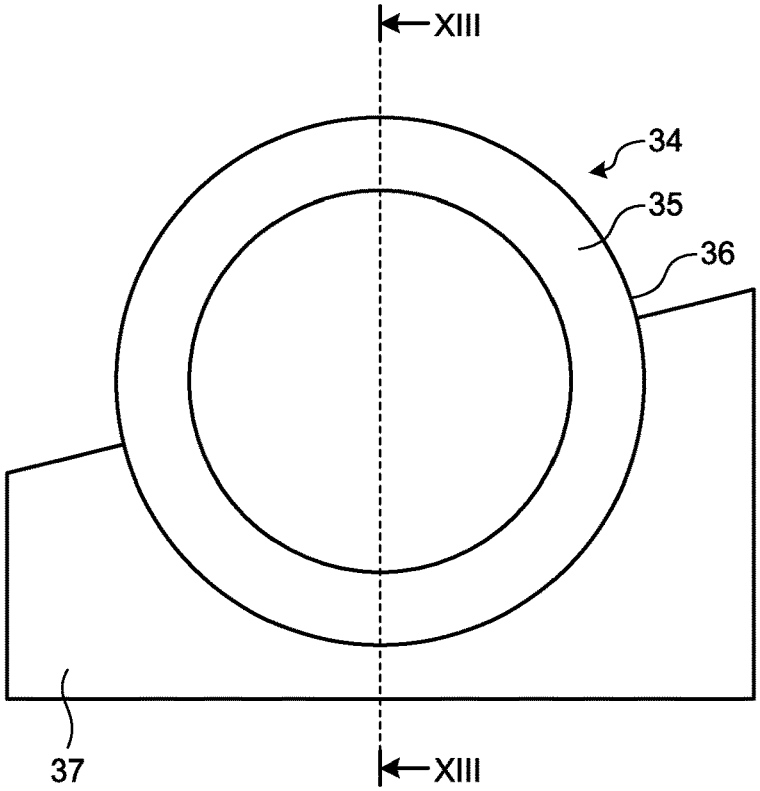
FIG. 12 is a plan view of an air admitting portion of the ventilation fan according to the third embodiment.
Figure 13:
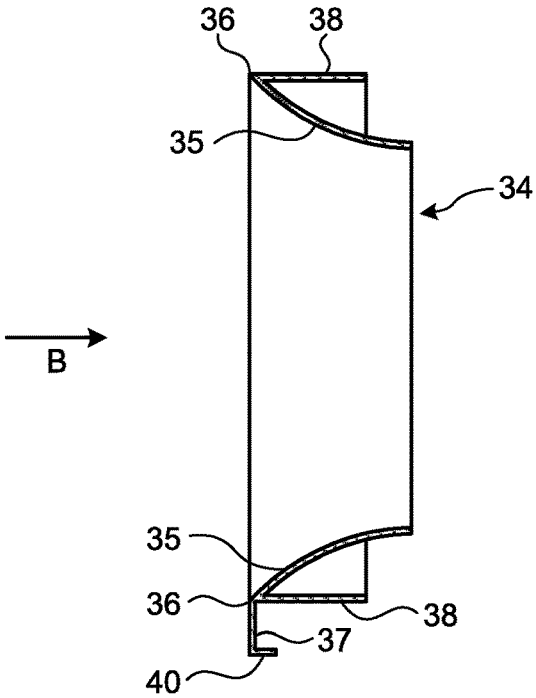
FIG. 13 is a sectional view of the air admitting portion of the ventilation fan according to the third embodiment.

FIG. 12 is a plan view of an air admitting portion of the ventilation fan according to the third embodiment of the present invention. FIG. 13 is a sectional view of the air admitting portion of the ventilation fan according to the third embodiment. FIG. 13 illustrates a section along line XIII-XIII in FIG. 12. A direction of the inlet air flow is indicated by an arrow B in FIG. 13. Specifically, the direction the arrow B points to in FIG. 13 is the inlet-air-flow downstream side. In the ventilation fan 31 according to the third embodiment, an air admitting portion 34 is a separate member from the scroll casing 32. After the centrifugal fan 33 is assembled, a protruding portion 37, which extends in the direction orthogonal to the axis line A, which is the rotation center of the impeller 2, and in the direction away from the axis line A is placed on a large-diameter side end 36 of a bell mouth portion 35 of the air admitting portion 34. After the centrifugal fan 33 is assembled, a support portion 38, which extends along the axis line A of the drive motor 3 on the inlet-air-flow downstream side is also placed on the large-diameter side end 36 of the bell mouth portion 35. As illustrated in FIG. 11, after the centrifugal fan 33 is assembled, the support portion 38 abuts an inlet-port face 39 of the scroll casing 32 so as to support the bell mouth portion 35 and position the air admitting portion 34 in the direction along the axis line A.

The air admitting portion 34 includes, in an area where the protruding portion 37 abuts the housing 5, a fixing margin 40 that has a hole or a slit. The air admitting portion 34 is fixed to the housing 5 by passing a screw through the fixing margin 40 and fastening the screw to the housing 5. Alternatively, the fixing margin 40 may be placed in an area where the support portion 38 abuts the inlet-port face 39 such that the air admitting portion 34 is fixed to the scroll casing 32.

The scroll casing 32 and the air admitting portion 34 are made from a metal material.

In the ventilation fan 31 according to the third embodiment, the air admitting portion 34 is a separate member from the scroll casing 32. Hence, the structure of the air admitting portion 34 is simplified, and, thus, fabrication of a die used for forming the air admitting portion 34 is facilitated.

Since the ventilation fan 31 according to the third embodiment includes the scroll casing 32 and the air admitting portion 34, which are separate from each other, a complex machining process to fabricate the scroll casing 32 is eliminated, and, thus, the fabrication of the scroll casing 32 is facilitated. Since the fabrication of the die used for forming the air admitting portion 34 by die forming is also facilitated, the ventilation fan 31 according to the third embodiment can reduce manufacturing costs.

The protruding portion 37 prevents the inlet air from flowing into the extra-pathway space 21 located between the air admitting portion 34 and the inner surface 20 of the housing 5 and guides the inlet air toward the bell mouth portion 35; thus, the ventilation fan 31 according to the third embodiment can reduce the unevenness in distribution of the speed of the inlet air flowing into the scroll casing 32 through the air admitting portion 34. Additionally, the protruding portion 37 covers the extra-pathway space 21 and thereby can inhibit a resonance from being produced in the extra-pathway space 21. In this manner, the ventilation fan 31 according to the third embodiment can reduce a noise during the operation of the centrifugal fan 33.

The protruding portion 37 may abut the housing 5 or be away from the housing 5. The scroll casing 32 and the air admitting portion 34 may be made from a resin material.

Fourth Embodiment

Figure 14:
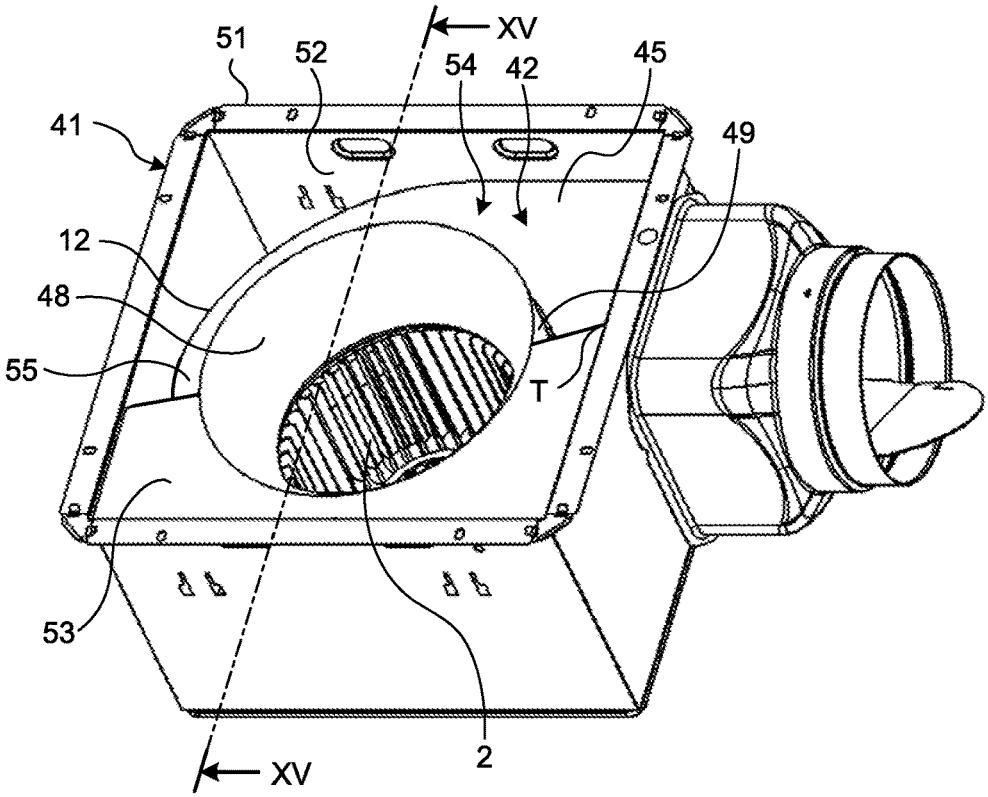
FIG. 14 is a perspective view of a ventilation fan according to a fourth embodiment.
Figure 15:
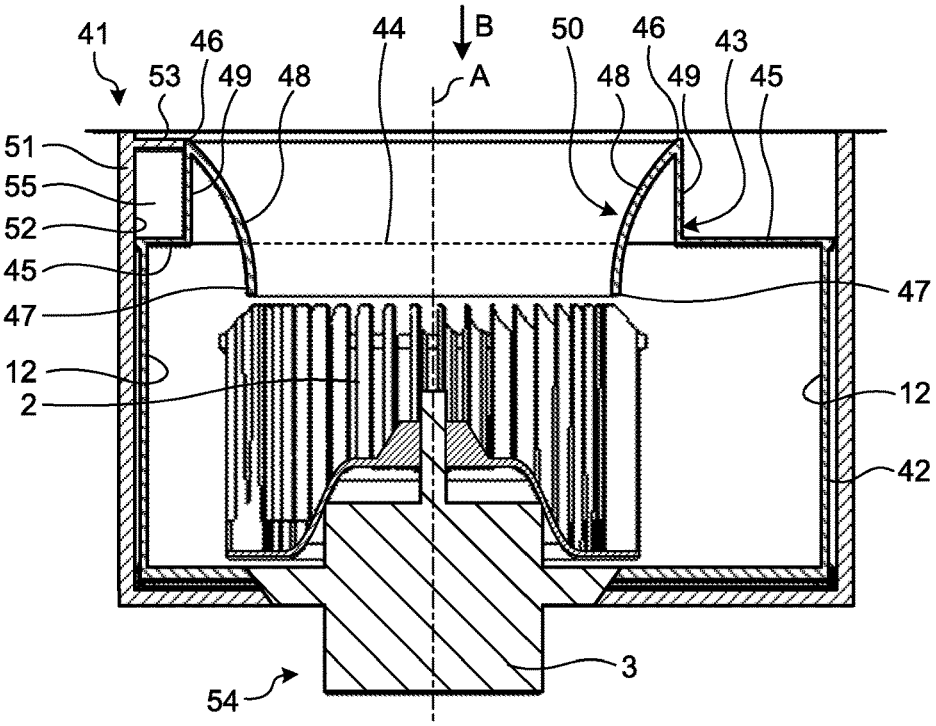
FIG. 15 is a sectional view of the ventilation fan according to the fourth embodiment.

FIG. 14 is a perspective view of a ventilation fan according to a fourth embodiment of the present invention. FIG. 15 is a sectional view of the ventilation fan according to the fourth embodiment. FIG. 15 illustrates a section along line XV-XV in FIG. 14. In a ventilation fan 41 according to the fourth embodiment, an air admitting portion 43 included in a scroll casing 42 includes an inlet portion 50, which includes a bell mouth portion 48, which penetrates an inlet-port face 45 having an opening 44 and has a large-diameter side end 46 placed on the inlet-air-flow upstream side of the inlet-port face 45 and a small-diameter side end 47 placed on the inlet-air-flow downstream side of the inlet-port face 45, and a support portion 49, which extends from the large-diameter side end 46 of the bell mouth portion 48 in the inlet-air-flow downstream direction so as to connect the bell mouth portion 48 to the inlet-port face 45 and support the bell mouth portion 48. The position of the opening 44 is indicated by a phantom line in FIG. 15. A direction of the inlet air flow is indicated by an arrow B in FIG. 15. Specifically, the direction the arrow B points to in FIG. 15 is the inlet-air-flow downstream side.

A protruding portion 53 is placed on an inner surface 52 of a housing 51. The protruding portion 53 extends from an intersection point T of a plane including a point at which the distance from the axis line A to the wall portion 12 of the scroll casing 42 is minimum and the axis line A and the inner surface 52 of the housing 51 in the rotation direction of the impeller 2. The scroll casing 42 and the housing 51 are made from a metal material. The other parts are similar to those of the first embodiment.

The drive motor 3, the impeller 2, and the scroll casing 42 configure a centrifugal fan 54. The centrifugal fan 54 is accommodated in the housing 51. As in the case with the scroll casing 4 according to the first embodiment, the scroll casing 42 changes an air flow in the centrifugal direction generated by the rotation of the impeller 2 into an air flow in one direction.

The protruding portion 53 extends from the inner surface 52 of the housing 51 in the direction orthogonal to the axis line A, which is the rotation center of the impeller 2, and in a direction toward the axis line A and abuts the large-diameter side end 46 of the bell mouth portion 48.

The protruding portion 53 prevents the inlet air from flowing into an extra-pathway space 55, which is a space located between the air admitting portion 43 and the inner surface 52 of the housing 51 and guides the inlet air toward the bell mouth portion 48; thus, the ventilation fan 41 according to the fourth embodiment can reduce the unevenness in distribution of the speed of the inlet air flowing into the scroll casing 42 through the air admitting portion 43. Additionally, the protruding portion 53 covers the extra-pathway space 55 and thereby can inhibit a resonance from being produced in the extra-pathway space 55. In this manner, the ventilation fan 41 according to the fourth embodiment can reduce a noise during the operation of the centrifugal fan 54.

The protruding portion 53 does not necessarily need to abut the large-diameter side end 46 of the bell mouth portion 48. In other words, a gap may be present between the large-diameter side end 46 of the bell mouth portion 48 and the protruding portion 53. It should be noted, however, that the effect of reducing the unevenness in distribution of the speed of the inlet air flowing into the scroll casing 42 through the air admitting portion 43 and the effect of inhibiting a resonance from being produced in the extra-pathway space 55 are greater when the protruding portion 53 abuts the large-diameter side end 46 of the bell mouth portion 48. The scroll casing 42 may be made from a resin material. The protruding portion 53 may surround the entire circumference of the bell mouth portion 48.

Note that the configurations described in the foregoing embodiments are examples of the present invention; combining the present invention with other publicly known techniques is possible, and partial omissions and modifications are possible without departing from the spirit of the present invention.

REFERENCE SIGNS LIST

1, 25, 31, 41 ventilation fan; 2 impeller; 3 drive motor; 4, 26, 32, 42 scroll casing; 5, 51 housing; 6 duct connection member; 7 shutter; 8, 30, 33, 54 centrifugal fan; 9, 44 opening; 10, 39, 45 inlet-port face; 11 tongue portion; 12 wall portion; 13, 27, 34, 43 air admitting portion; 14, 29, 50 inlet portion; 15, 28, 37, 53 protruding portion; 16, 36, 46 large-diameter side end; 17, 47 small-diameter side end; 18, 35, 48 bell mouth portion; 19, 38, 49 support portion; 20, 52 inner surface; 21, 55 extra-pathway space; 22, 23, 24 air flow; 40 fixing margin.

The invention claimed is:

1. A centrifugal fan, comprising:

an impeller to be driven by a drive motor so as to rotate;

a scroll casing to change an air flow in a centrifugal direction generated by rotation of the impeller into an air flow in one direction, the scroll casing including an inlet-port face having an opening, and a wall portion having positions at which distances from an axis line that is a rotation center of the impeller differ from each other;

an air admitting portion including a bell mouth portion having a large-diameter side end placed on an inlet-air-flow upstream side of the inlet-port face; and a protruding portion extending, on the inlet-air-flow upstream side of the inlet-port face, from part of an entire circumference of the air admitting portion in a direction orthogonal to the axis line and in a direction away from the axis line, wherein the protruding portion surrounds less than 100% of the bell-mouth portion.

2. The centrifugal fan according to claim 1, wherein the protruding portion extends over part of the inlet-port face.

3. The centrifugal fan according to claim 1, wherein the air admitting portion is formed integrally with the scroll casing.

4. The centrifugal fan according to claim 1, wherein the protruding portion extends from the large-diameter side end of the bell mouth portion.

5. The centrifugal fan according to claim 1, wherein at least part of the protruding portion extends so as to reach an extension of the wall portion in a direction along the axis line.

6. The centrifugal fan according to claim 1, wherein the protruding portion extends from an intersection point of a plane including a point at which a distance from the axis line to the wall portion is minimum and the axis line and the large-diameter side end in a rotation direction of the impeller.

7. The centrifugal fan according to claim 6, wherein the protruding portion has a size achieved when a center angle about the axis line is equal to or greater than 110° and equal to or smaller than 270°.

8. The centrifugal fan according to claim 7, wherein the protruding portion has a size achieved when the center angle is equal to or greater than 120° and equal to or smaller than 225°.

9. A ventilation fan, comprising the centrifugal fan according to claim 1 accommodated in a housing, wherein a space located between an inner surface of the housing and the air admitting portion is partially covered by the protruding portion along a circumferential direction of the bell-mouth.

10. A ventilation fan, comprising:

a centrifugal fan including:

an impeller to be driven by a drive motor so as to rotate;

a scroll casing to change an air flow in a centrifugal direction generated by rotation of the impeller into an air flow in one direction, the scroll casing including an inlet-port face having an opening, and a wall portion having positions at which distances from an axis line that is a rotation center of the impeller differ from each other;

an air admitting portion including a bell mouth portion having a large-diameter side end placed on an inlet-air-flow upstream side of the inlet-port face; and a protruding portion extending from part of an entire circumference of the air admitting portion in a direction orthogonal to the axis line and in a direction away from the axis line and surrounding less than 100% of the bell mouth portion; and a housing accommodating the centrifugal fan, wherein a space located between an inner surface of the housing and the air admitting portion is partially covered by the protruding portion along a circumferential direction of the bell-mouth.

11. The ventilation fan according to claim 10, wherein the protruding portion abuts the inner surface of the housing.

12. A ventilation fan, comprising a centrifugal fan accommodated in a housing, wherein the centrifugal fan includes:

an impeller to be driven by a drive motor so as to rotate;

a scroll casing to change an air flow in a centrifugal direction generated by rotation of the impeller into an air flow in one direction, the scroll casing including an inlet-port face having an opening, and a wall portion having positions at which distances from an axis line that is a rotation center of the impeller differ from each other; and an air admitting portion including a bell mouth portion having a large-diameter side end placed on an inlet-air-flow upstream side of the inlet-port face, and the housing includes a protruding portion extending, on the inlet-air-flow upstream side of the inlet-port face, from an inner surface of the housing in a direction orthogonal to the axis line and in a direction toward the axis line and partially covering a space located between the inner surface and the air admitting portion along a circumferential direction of the bell-mouth, wherein the protruding portion surrounds less than 100% of the bell-mouth portion.

13. The ventilation fan according to claim 12, wherein the protruding portion abuts the large-diameter side end of the bell mouth portion.

14. The ventilation fan according to claim 12, wherein the protruding portion extends from an intersection point of a plane including a point at which a distance from the axis line to the wall portion is minimum and the axis line and the inner surface in a rotation direction of the impeller.

* * * * *